US005511541A

United States Patent [19]

Dearstine

[11] Patent Number: 5,511,541

[45] Date of Patent: Apr. 30, 1996

[54] WARM AIR MASK

[76] Inventor: Walter R. Dearstine, 5206 W. Sharps Ridge Rd., McConnelsville, Ohio 43756

[21] Appl. No.: 511,371

[22] Filed: Aug. 4, 1995

[51] Int. Cl.[6] ..... A62B 18/08

[52] U.S. Cl. ..... 128/201.13; 128/203.27; 128/204.17

[58] Field of Search ..... 128/201.13, 203.27, 128/204.17

[56] References Cited

U.S. PATENT DOCUMENTS

| | | | |
|---|---|---|---|
| 2,410,903 | 11/1946 | Rogge | 128/203.27 |
| 3,249,108 | 5/1966 | Terman | 128/204.17 |
| 3,491,754 | 1/1970 | Weese | 128/204.17 |
| 3,814,094 | 6/1974 | De Angelis et al. | 128/201.13 |
| 4,269,183 | 5/1981 | Hunt | 128/201.13 |
| 4,412,537 | 11/1983 | Tiger | 128/204.17 |
| 4,458,679 | 7/1984 | Ward | 128/201.13 |
| 4,601,287 | 7/1986 | Royce, Jr. | 128/204.17 |
| 4,620,537 | 11/1986 | Brown | 128/204.17 |
| 4,671,268 | 6/1987 | Hunt | 128/201.13 |
| 4,793,343 | 12/1988 | Cummins, Jr. et al. | 128/203.27 |
| 4,825,474 | 5/1989 | Edwards | 2/206 |
| 4,905,686 | 3/1990 | Adams | 128/204.17 |

*Primary Examiner*—Aaron J. Lewis

[57] ABSTRACT

A warm air mask comprising a facial covering configured to form an upper edge positionable above the nose of a wearer, a lower edge positionable beneath the chin of a wearer, and side edges positionable beyond the ears of a wearer; a plurality of oval inhale ports formed in the covering and extending therethrough, each inhale port including a flap to open with the inhaling of a wearer and to close with the exhaling of a wearer. An exhale port is formed in the covering and extending therethrough, the exhale port including a flap to open with the exhaling of a wearer and to close with the inhaling of a wearer. Further, an array of electrical resistance wires for generating heat when electrically activated, the array being positioned in each inhale port with an associated electrical power source for selectively activating and inactivating the resistance wires.

5 Claims, 4 Drawing Sheets

WARM AIR MASK

BACKGROUND OF THE INVENTION

1. Field of the Invention

The present invention relates to a warm air mask and, more particularly, pertains to maintaining warm and dry the face of a wearer.

2. Description of the Prior Art

The use of warming devices of various designs and configurations is known in the prior art. More specifically, warming devices of various designs and configurations heretofore devised and utilized for the purpose of warming or drying objects by various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,117,821, a hunting mask with breath odor control system.

U.S. Pat. No. 4,905,686 discloses a cold weather breathing mask.

U.S. Pat. No. 4,825,474 discloses a cold weather mask.

U.S. Pat. No. 4,671,268 discloses a cold weather breathing mask.

U.S. Pat. No. 4,458,679 discloses a cold weather respirator mask.

Lastly, U.S. Pat. No. 4,269,183 discloses a cold weather breathing mask.

In this respect, the warm air mask according to the present invention substantially departs from the conventional concepts and designs of the prior art, and in so doing provides an apparatus primarily developed for the purpose of maintaining warm and dry the face of a wearer.

Therefore, it can be appreciated that there exists a continuing need for a new and improved warm air mask which can be used for maintaining warm and dry the face of a wearer. In this regard, the present invention substantially fulfills this need.

SUMMARY OF THE INVENTION

In view of the foregoing disadvantages inherent in the known types of warming devices of various designs and configurations now present in the prior art, the present invention provides an improved warm air mask. As such, the general purpose of the present invention, which will be described subsequently in greater detail, is to provide a new and improved warm air mask and method which has all the advantages of the prior art and none of the disadvantages.

To attain this, the present invention essentially comprises a warm air mask comprising, in combination, a facial covering positionable over the mouth, nose, chin and cheeks of a wearer, the covering including an interior layer of a stay dry material, an exterior layer of a stay dry material and an intermediate layer of felt therebetween, the covering configured to form an upper edge positionable above the nose of a wearer, a lower edge positionable beneath the chin of a wearer, and side edges positionable beyond the ears of a wearer; three oval inhale ports formed in the covering and extending therethrough, each inhale port including a fabric mesh and an imperforate flexible flap to open with the inhaling of a wearer and to close with the exhaling of a wearer; a single circular exhale port formed centrally in the covering and extending therethrough, the exhale port including an imperforate flexible flap to open with the exhaling of a wearer and to close with the inhaling of a wearer; an array of electrical resistance wires for generating heat when electrically activated, the wires of the array being positioned in each inhale port with an associated electrical power source and a switch secured adjacent to the covering for selectively activating and inactivating the resistance wires; a pair of parallel securement straps having first ends fixedly secured to one edge of the covering and second ends separably secured to the other edge of the covering; pile type fasteners releasably securing the other edge of the covering to the second ends of the straps; and adjustment members located on the straps intermediate the ends.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved warm air mask which has all the advantages of the prior art warming devices of various designs and configurations and none of the disadvantages.

It is another object of the present invention to provide a new and improved warm air mask which may be easily and efficiently manufactured and marketed.

It is a further object of the present invention to provide a new and improved warm air mask which is of a durable and reliable construction.

An even further object of the present invention is to provide a new and improved warm air mask which is susceptible of a low cost of manufacture with regard to both materials and labor, and which accordingly is then susceptible of low prices of sale to the consuming public, thereby making such warming devices of various designs and configurations economically available to the buying public.

Still yet another object of the present invention is to provide a new and improved warm air mask which provides in the apparatuses and methods of the prior art some of the advantages thereof, while simultaneously overcoming some of the disadvantages normally associated therewith.

Even still another object of the present invention is to maintaining warm and dry the face of a wearer.

Lastly, it is an object of the present invention to provide a warm air mask comprising a facial covering configured to form an upper edge positionable above the nose of a wearer, a lower edge positionable beneath the chin of a wearer, and side edges positionable beyond the ears of a wearer; a plurality of oval inhale ports formed in the covering and extending therethrough, each inhale port including a flap to open with the inhaling of a wearer and to close with the exhaling of a wearer; an exhale port formed in the covering and extending therethrough, the exhale port including a flap to open with the exhaling of a wearer and to close with the inhaling of a wearer; and an array of electrical resistance wires for generating heat when electrically activated, the array being positioned in each inhale port with an associated electrical power source for selectively activating and inactivating the resistance wires.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
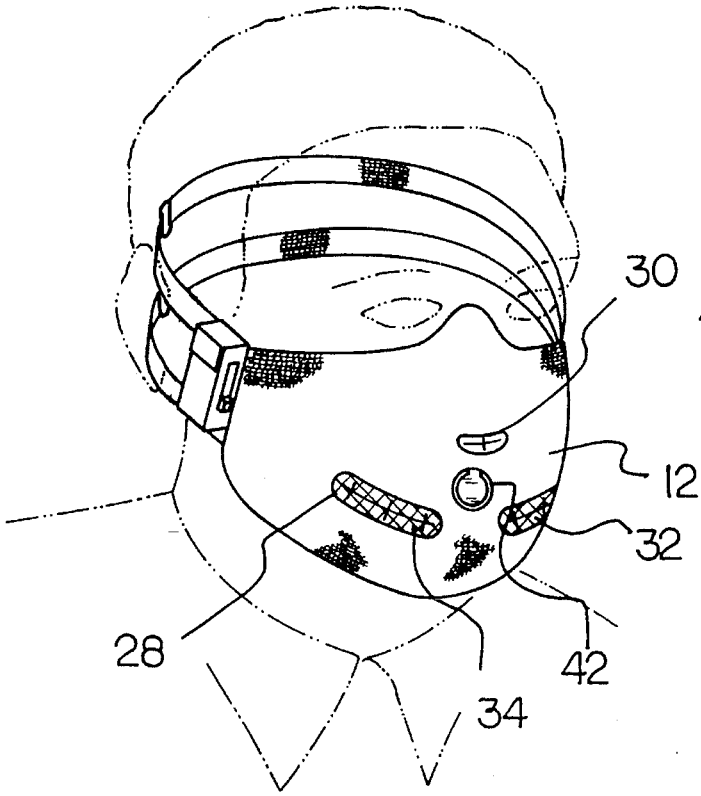
FIG. 1 is a perspective illustration of the preferred embodiment of the warm air mask constructed in accordance with the principles of the present invention.
Figure 2:
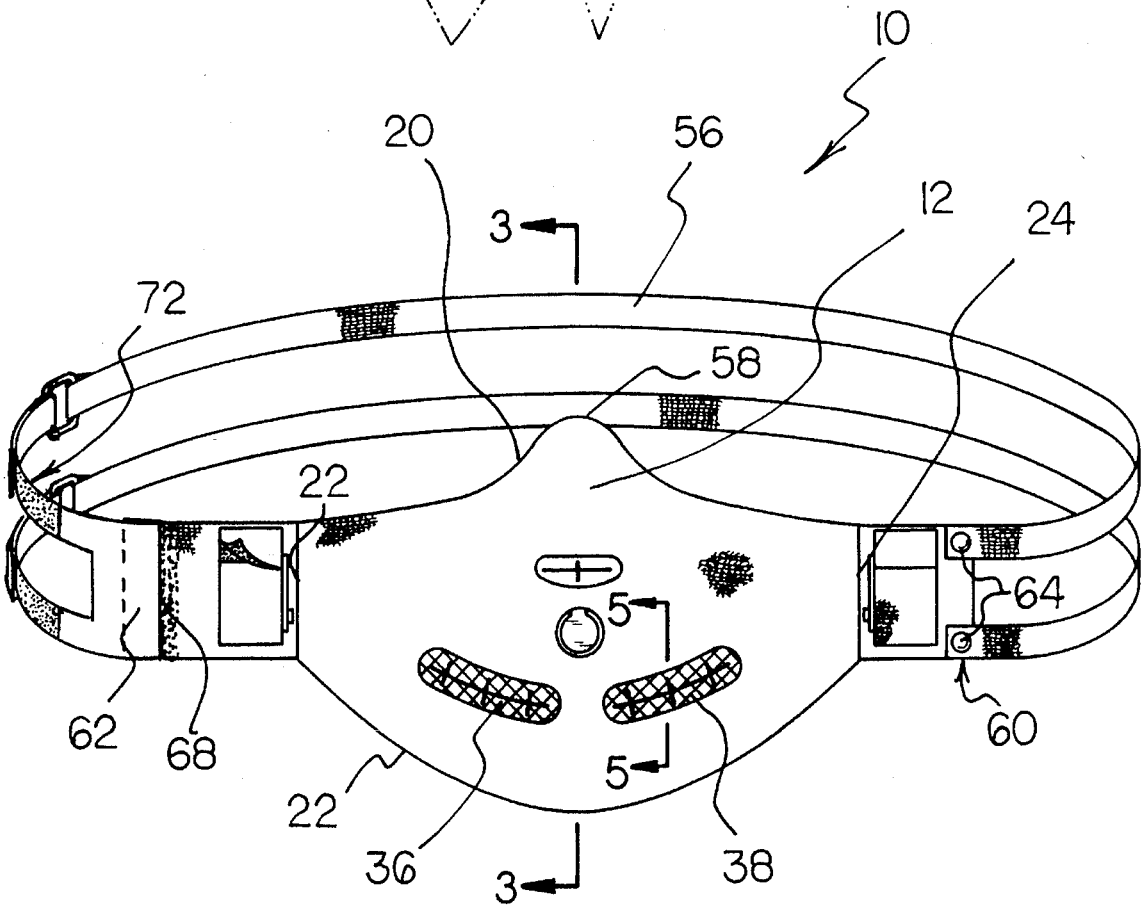
FIG. 2 is a is a perspective showing of the mask of FIG. 1 but illustrated off of a wearer.
Figure 3:
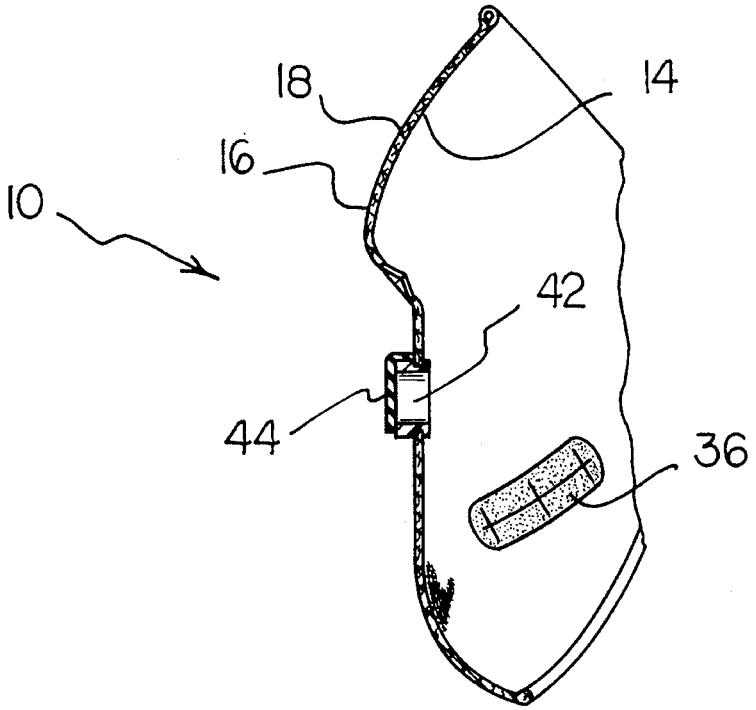
FIG. 3 is a cross sectional view taken along line 3—3 of FIG. 2.
Figure 4:
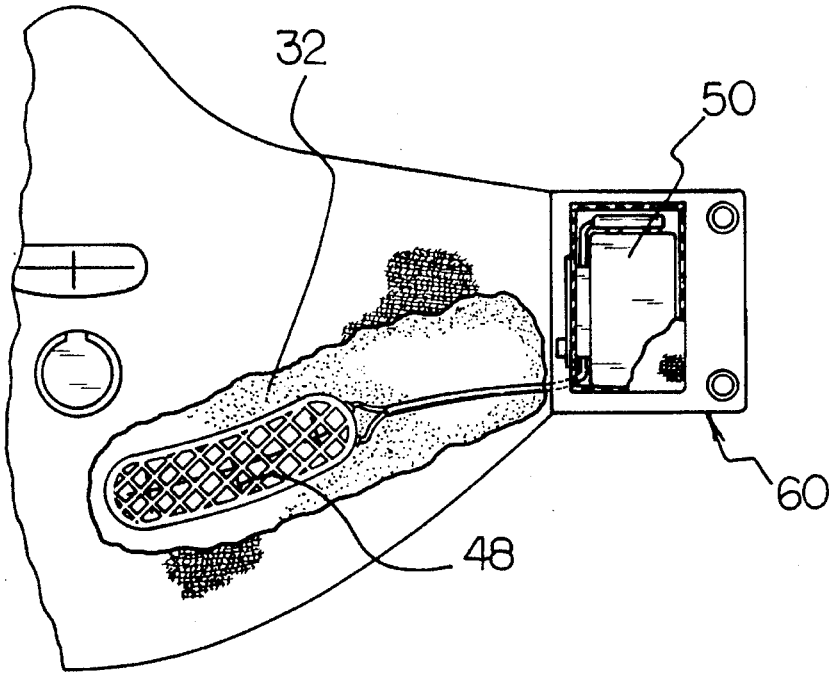
FIG. 4 is an enlarged fragmentary view of one side edge of the mask with parts broken away to illustrate certain internal constructions thereof.
Figure 5:
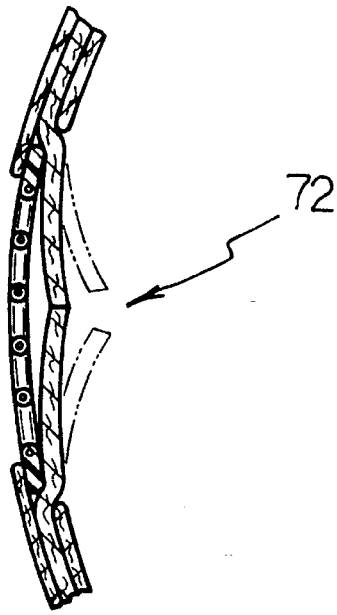
FIG. 5 is a cross sectional view taken along line 5—5 of FIG. 2.
Figure 6:
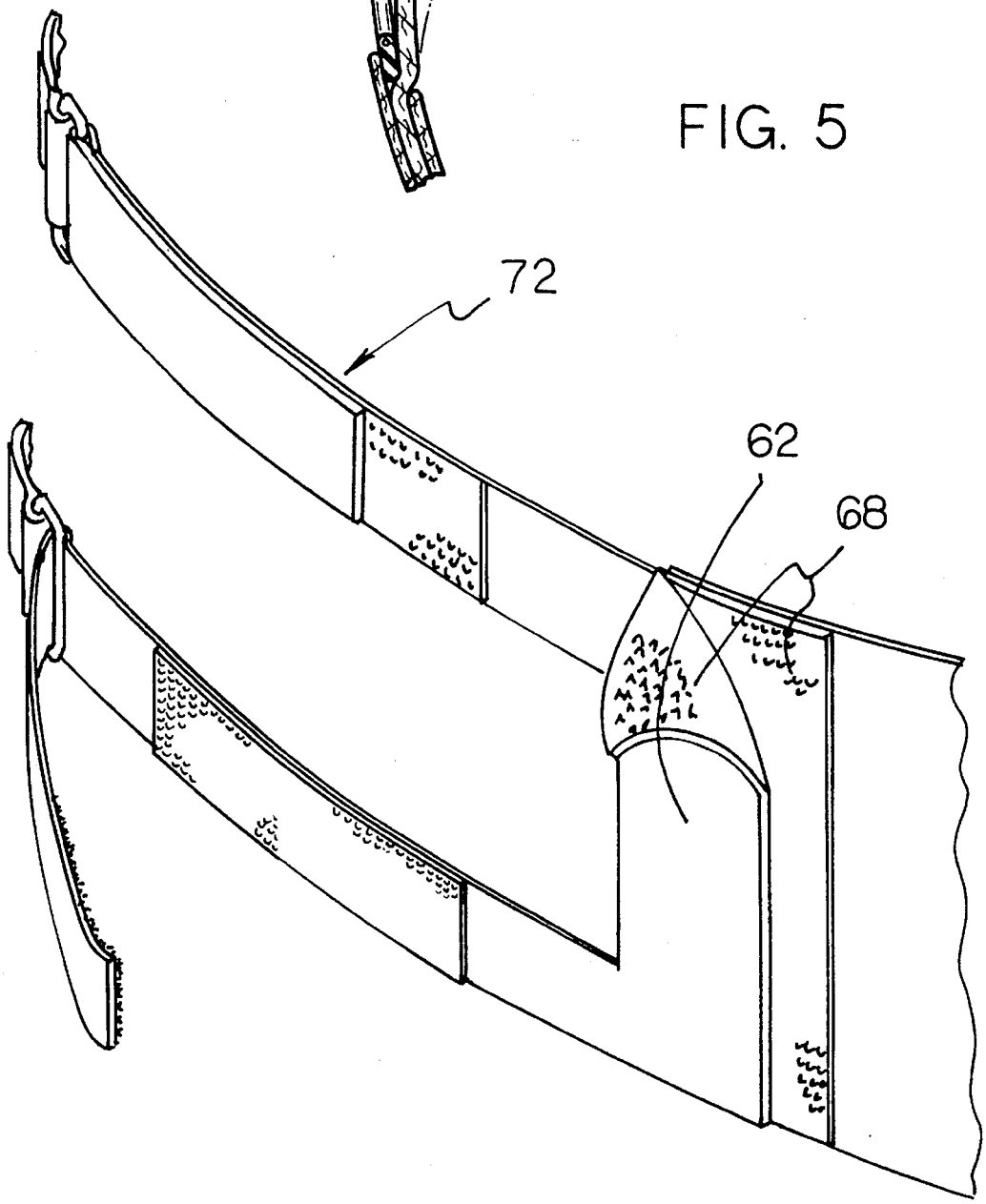
FIG. 6 is an enlarged perspective illustration of the strap with its releasible coupling nd adjustment components.
Figure 7:
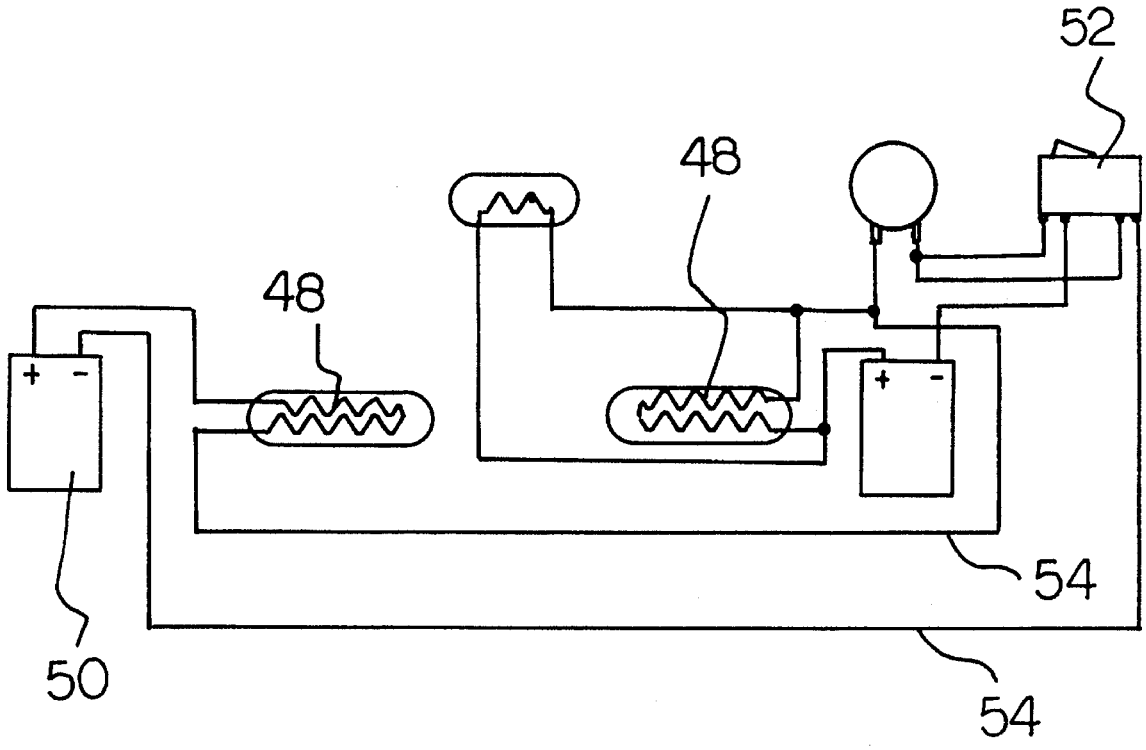
FIG. 7 is a schematic illustration of the electrical components of the device of the prior Figures.

With reference now to the drawings, and in particular to FIG. 1 thereof, the preferred embodiment of the new and improved warm air mask embodying the principles and concepts of the present invention and generally designated by the reference numeral 10 will be described.

The present invention, the new and improved warm air mask, is a system 10 comprised of a plurality of components. In their broadest context, the components include a facial covering, inhale ports, an exhale port, electrical resistance wires, securement straps, fasteners and adjustment members. Each of the individual components is specifically configured and correlated one with respect to the other so as to attain the desired objectives.

More specifically, the system 10 of the present invention includes a facial covering 12. Such covering is positionable over the mouth, nose, chin and cheeks of a wearer. The covering includes an interior layer 14 of a stay dry material, preferably a flexible plastic. The covering also includes an exterior layer 16 of a stay dry material, also preferably a flexible plastic. In addition, for comfort there is provided an intermediate layer 18 of felt between the interior and exterior layers. The covering is configured to form an upper edge 20 positionable above the nose of a wearer, a lower edge 22 positionable beneath the chin of a wearer, and side edges 22,24 positionable beyond the ears of a wearer.

Three oval inhale ports 28, 30, 32 are formed in the covering. Such ports extend through the covering. Each inhale port including a fabric mesh 34 and an imperforate flexible flap 36, 38. Such flaps function independently to open with the inhaling of a wearer and to close with the exhaling of a wearer.

In addition to the inhale ports, there is also provided a single circular exhale port 42. Such inhale port is formed centrally in the covering and extending therethrough. The exhale port includes an imperforate flexible flap 44. Such port functions to open with the exhaling of a wearer and to close with the inhaling of a wearer. The plurality of ports and flaps thus work together to allow for breathing by a wearer.

An additional feature of the present invention is an array of electrical resistance wires 48. Such wires are provided for generating heat when electrically activated. The wires of the array are positioned in each inhale port with an associated electrical power source 50 and a switch 52 which are secured adjacent to the covering for selectively activating and inactivating the resistance wires. Appropriate electrical lines 54 couple the electrical wires, power source and switch.

Securement of the covering and its components are achieved by a pair of parallel securement straps 56, 58. Such straps have first ends 60 fixedly secured to one edge of the covering and second ends 62 separably secured to the other edge of the covering. The first ends are preferably coupled through snaps 64.

Pile type fasteners 68 are provided for releasably securing the other edge of the covering to the second ends of the straps.

The last components of the present invention are adjustment members 72. Such adjustment members are of a conventional configuration. They are preferably located on the straps intermediate the ends.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved warm air mask comprising, in combination:

a facial covering positionable over the mouth, nose, chin and cheeks of a wearer, the covering including an interior layer of a stay dry material, an exterior layer of a stay dry material and an intermediate layer of felt therebetween, the covering configured to form an upper edge positionable above the nose of a wearer, a lower edge positionable beneath the chin of a wearer, and side edges positionable beyond the ears of a wearer;

three oval inhale ports formed in the covering and extending therethrough, each inhale port including a fabric mesh and an imperforate flexible flap to open with the inhaling of a wearer and to close with the exhaling of a wearer;

a single circular exhale port formed centrally in the covering and extending therethrough, the exhale port including an imperforate flexible flap to open with the exhaling of a wearer and to close with the inhaling of a wearer;

an array of electrical resistance wires for generating heat when electrically activated, the wires of the array being positioned in each inhale port with an associated electrical power source and a switch secured adjacent to the covering for selectively activating and inactivating the resistance wires;

a pair of parallel securement straps having first ends fixedly secured to one edge of the covering and second ends separably secured to the other edge of the covering;

pile type fasteners releasably securing the other edge of the covering to the second ends of the straps; and adjustment members located on the straps intermediate the ends.

2. A warm air mask comprising, in combination:

a facial covering configured to form an upper edge positionable above the nose of a wearer, a lower edge positionable beneath the chin of a wearer, and side edges positionable beyond the ears of a wearer;

a plurality of oval inhale ports formed in the covering and extending therethrough, each inhale port including a flap to open with the inhaling of a wearer and to close with the exhaling of a wearer;

an exhale port formed in the covering and extending therethrough, the exhale port including a flap to open with the exhaling of a wearer and to close with the inhaling of a wearer; and an array of electrical resistance wires for generating heat when electrically activated, the array being positioned in each inhale port with an associated electrical power source for selectively activating and inactivating the resistance wires.

3. The device as set forth in claim 2 and further including:

a pair of parallel securement straps having first ends fixedly secured to one edge of the covering and second ends separably secured to the other edge of the covering.

4. The device as set forth in claim 3 and further including:

pile type fasteners releasably securing the other edge of the covering to the second ends of the straps.

5. The device as set forth in claim 3 and further including:

adjustment members located on the straps intermediate the ends.

* * * * *